United States Patent [19]

Geller

[11] Patent Number: 4,458,200

[45] Date of Patent: Jul. 3, 1984

[54] REFERENCE VOLTAGE SOURCE

[75] Inventor: William L. Geller, Tempe, Ariz.

[73] Assignee: GTE Laboratories Incorporated, Waltham, Mass.

[21] Appl. No.: 438,090

[22] Filed: Nov. 1, 1982

[51] Int. Cl.[3] ..... G05F 3/08; G05F 1/46

[52] U.S. Cl. ..... 323/316; 323/350; 307/297

[58] Field of Search ..... 323/313, 314, 315, 316, 323/349, 350; 307/296 R, 297; 330/257, 288, 296, 297

[56] References Cited

U.S. PATENT DOCUMENTS

| | | | |
|---|---|---|---|
| 3,887,863 | 6/1975 | Brokaw | 323/314 |
| 4,100,436 | 7/1978 | van de Plassche | 323/315 X |
| 4,185,236 | 1/1980 | van de Plassche et al. | 323/316 |
| 4,251,743 | 2/1981 | Hareyama | 323/316 X |
| 4,327,320 | 4/1982 | Oguey et al. | 323/316 X |
| 4,339,707 | 7/1982 | Gorecki | 323/313 |

OTHER PUBLICATIONS

Widlar, R. J., "New Developments in IC Voltage Regulator," Linear Circuit Techniques, Digest of Technical Papers, 1970 IEEE International Solid State Circuits Conference, Feb. 20, 1970, pp. 158–159.

Kash, R., "Building Qualty Analog Circuits with C-MOS Logic Arrays", Electronics, Aug. 11, 1981, pp. 109–112.

*Primary Examiner*—Peter S. Wong

*Attorney, Agent, or Firm*—David M. Keay

[57] ABSTRACT

Band gap voltage regulator employing a self-balancing bridge circuit for controlling current flow through two parallel branches. Voltage points in each branch are alternately sampled and applied to one input of a comparator in a delta modulator circuit. The output of the delta modulator circuit is applied to the other input of the comparator. The output of the comparator is applied to a control circuit which controls a current source in each of the two branches. The voltages at each voltage point are alternately compared with the voltage at the other input of the comparator, and the result is employed to control the current sources so that the voltages at both points are equalized despite any offset voltage in the comparator.

6 Claims, 3 Drawing Figures

PRIOR ART

REFERENCE VOLTAGE SOURCE

BACKGROUND OF THE INVENTION

This invention relates to stable reference voltage sources. More particularly, it is concerned with band gap voltage regulators.

There are many situations which require temperature stable reference voltage sources. For use in integrated circuit form it is necessary that the components of a reference voltage source be compatible with the particular integrated circuit technology. One known type of reference voltage source which is compatible with conventional monolithic integrated circuits is a band gap voltage regulator. Certain parameters of a band gap voltage regulator have negative temperature coefficients and certain have positive temperature coefficients thereby, theoretically, providing an output voltage which is stable despite temperature variations. The stable output voltage obtained from a circuit of this type is approximately equal to the band gap voltage of the semiconductor material employed, typically silicon.

One form of band gap voltage regulator includes two series arrangements of transistors, current sources, and resistances. The two series arrangements are connected in parallel and there is a fixed ratio of relative current flow in the two arrangements. The amount of current flowing in each of the two series arrangements is adjusted to maintain the voltage at a certain point in one arrangement equal to that at a certain point in the other arrangement. The two points are connected to the inputs of an amplifier the output of which controls the current sources, thus providing a self-balancing bridge which adjusts current flow to maintain the two points at the same voltage. The offset voltage of the amplifier, however, may cause a significant differential voltage to be produced between the two points. Although various circuit arrangements have been devised to correct for the error caused by amplifier offset voltage, the residual error may have a significant effect on the stability of the output voltage produced by the regulator.

SUMMARY OF THE INVENTION

An improved source of reference voltage in accordance with the present invention comprises a first series arrangement including a first transistor means, a first resistance means, a second resistance means and a first voltage controllable current source means connected in series. A second series arrangement includes a second transistor means and a second voltage controlled current source means connected in series. An output terminal is connected between the juncture of the second resistance means and the first current source means in the first series arrangement. The source also includes a balancing means for equalizing the voltage at the juncture of the first and second resistance means and the juncture of the second transistor means and the second current source means. The balancing means includes comparator means having a first input, a second input and an output. The comparator means produces a first output condition at the output when the voltage at the first input is greater than the voltage at the second input, and produces a second output condition at the output when the voltage at the second output is greater than the voltage at the first input. Comparator input switching means alternately connect the first input of the comparator means to the juncture of the second transistor means and second current source means and to the juncture of the first and second resistance means. A first sampling means samples the output of the comparator means when the first input of the comparator means is connected to the juncture of the second transistor means and second current source means. A first storage means is coupled to the first sampling means and to the second input of the comparator means. The first storage means stores the output of the comparator means sampled by the first sampling means and applies a voltage representative thereof to the second input of the comparator means. A second sampling means samples the output of the comparator means when the first input of the comparator means is connected to the juncture of the first and second resistance means. A second storage means is coupled to the second sampling means and to both the first and second current source means. The second storage means stores the output of the comparator means sampled by the second sampling means and applies a voltage representative thereof to the first and second current source means. Current flow through the first and second series arrangements is controlled by the voltage applied to the first and second current source means so as to maintain the voltage at the juncture of the first and second resistance means substantially equal to the voltage at the juncture of the second transistor means and second current source means.

For a better understanding of the present invention together with other and further objects, advantages, and capabilities thereof, reference is made to the following discussion and appended claims in connection with the above-described drawings.

DETAILED DESCRIPTION OF THE INVENTION

Figure 1:
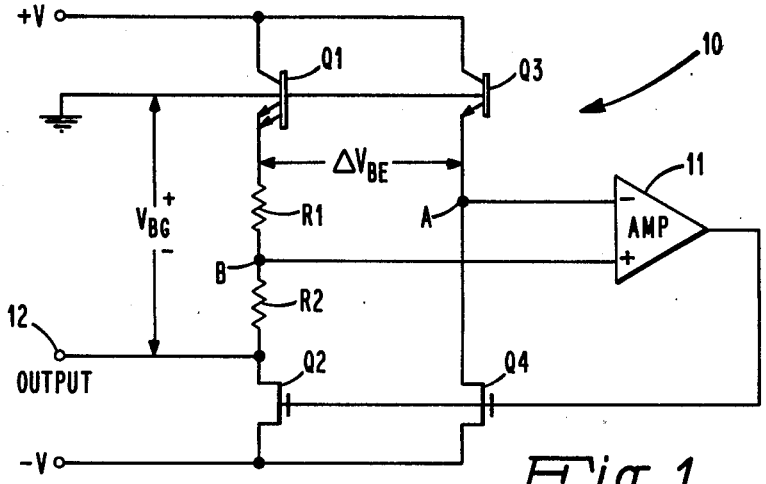
FIG. 1 is schematic circuit diagram of a prior art band gap voltage regulator.

FIG. 1 illustrates a prior art band gap voltage regulator 10. The regulator includes a first series arrangement of an NPN transistor Q1, a resistance R1, a resistance R2, and a voltage controlled current source of a MOSFET Q2 connected between positive and negative sources of operating potential +V and −V. The regulator also includes a second series arrangement of an NPN transistor Q3 and a voltage controlled current source of a MOSFET Q4 connected between the +V and the −V voltage sources. The output terminal 12 of the circuit is connected to the juncture of the resistance R2 and FET Q2. A feedback circuit including an amplifier 11 has one input connected to point A at the juncture of transistors Q3 and Q4 and the other input connected to point B at the juncture of the two resistances R1 and R2. The output of the amplifier 11 is applied to the gate or control electrodes of the FET's Q2 and Q4.

The emitter area of transistor Q1 is twice that of the emitter area of transistor Q3 as indicated by the dual emitter symbol for transistor Q1. The width-to-length ratio of FET Q4 is five times that of FET Q2. Therefore, for a given gate-to-source voltage at the gates of FET's Q2 and Q4 the current in FET Q4 is five times the current in FET Q2. As a result the emitter current density in transistor Q3, $J_3$, is ten times the emitter current density in transistor Q1, $J_1$. Since the emitter current density in transistor Q3, $J_3$, is ten times that in transistor Q1, $J_1$, the differential base-to-emitter voltage $\Delta V_{BE}$ is given by $$\Delta V_{BE}=(KT/q)\ln(J_3/J_1), \text{ where } J_3/J_1=10.$$

With KT/q=0.026 volts at room temperature $\Delta V_{BE}$ is approximately 60 millivolts.

The feedback loop of the amplifier 11 operates to maintain the voltages at points A and B, $V_A$ and $V_B$, equal to each other by adjusting the currents in the voltage controlled current sources of FET's Q2 and Q4. When $V_A$ is equal to $V_B$, the voltage across resistance R1 is equal to $\Delta V_{BE}$. The voltage between the output terminal 12 and ground, $V_{BG}$, thus may be expressed as $$V_{BG} = V_{BE(Q1)} + \left(1 + \frac{R2}{R1}\right) \Delta V_{BE}.$$

The forward diode drop of a transistor $V_{BE}$ has a negative temperature coefficient and as can be seen by the expression above $\Delta V_{BE}$ has a positive temperature coefficient. Thus by proper selection of the resistances R1 and R2 the two temperature coefficients cancel and the output voltage $V_{BG}$ becomes independent of temperature. This condition exists when $V_{BG}=-1.25$ volts, the silicon band gap voltage.

A problem with the regulator circuit illustrated in FIG. 1 is that with standard CMOS technology the offset voltage of the amplifier circuit is of the order of ±20 millivolts. Thus, rather than be equal $V_A$ and $V_B$ may vary by ±0.02 volts. This offset error is very significant when compared to the value of $\Delta V_{BE}$ of 0.06 volts.

Figure 2:
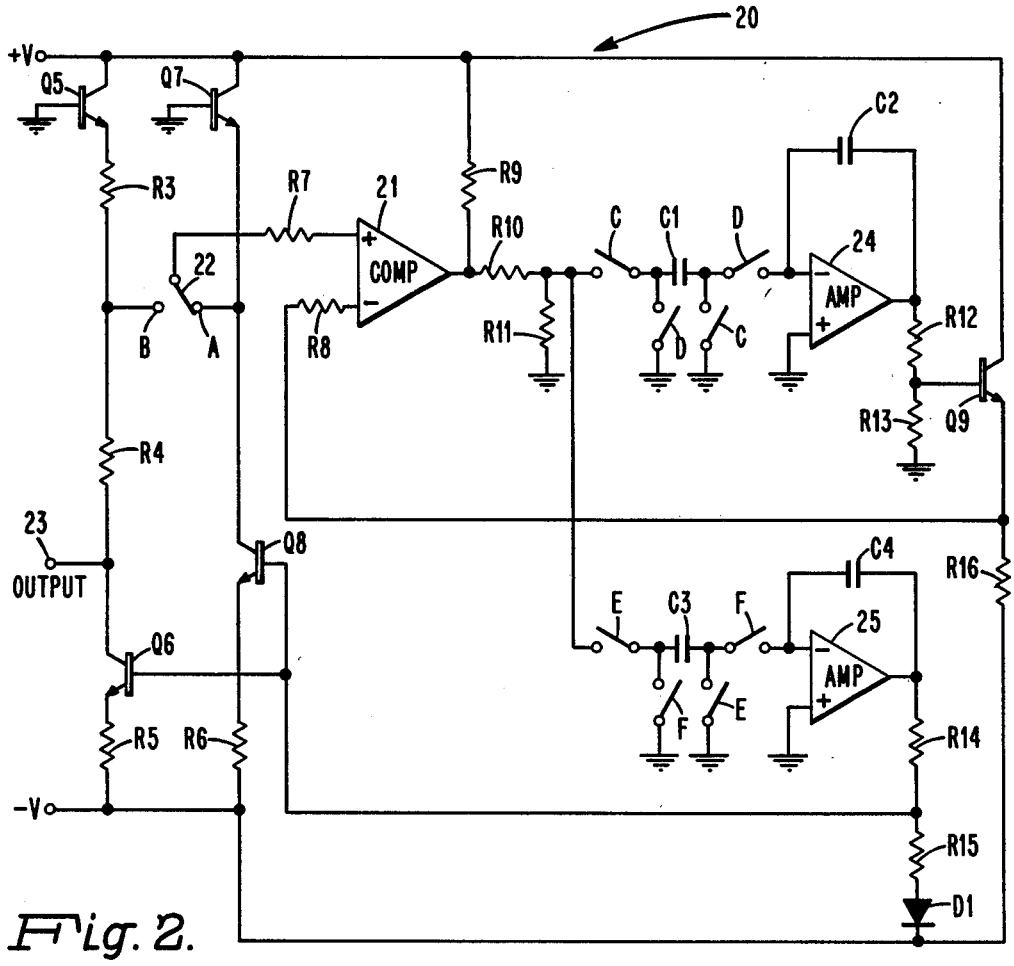
FIG. 2 is schematic circuit diagram of a band gap voltage regulator in accordance with the present invention.

FIG. 2 is a schematic circuit diagram of a band gap voltage regulator 20 in accordance with the present invention. The circuit includes a first series arrangement of an NPN transistor Q5, a resistance R3, a resistance R4, and a first voltage controlled current source of an NPN transistor Q6 and resistance R5 connected in series between +V and −V voltage sources. A second series arrangement is connected in parallel with the first series arrangement between the two voltage sources. The second arrangement includes an NPN transistor Q7 and a second voltage controlled current source of an NPN transistor Q8 and a resistance R6. The bases of transistors Q5 and Q7 are connected directly to ground. The output terminal 23 of the circuit is connected to the juncture of resistance R4 and transistor Q6.

As in FIG. 1 the juncture between transistor Q7 and the second current source is labeled point A and the juncture between resistances R3 and R4 is labeled point B. The feedback circuit for balancing the voltages at points A and B includes a comparator 21 having its + input connected by way of a resistance R7 to a switch 22. The switch 22 alternately connects the + input to point A and to point B.

The output of the comparator 21 is connected to the +V voltage source by way of a resistance R9 and to ground through resistances R10 and R11. The juncture of resistances R10 and R11 is connected to one terminal of a capacitance C1 by way of a first set of contacts of a switch C to form an integrating circuit. The other terminal of the capacitance C1 is connected to ground through a second set of contacts of the switch C. The one terminal of capacitance C1 is connected to ground through a first set of contacts of a switch D. The other terminal of capacitance C1 is connected through a second set of contacts of switch D to one terminal of a capacitance C2.

The one terminal of capacitance C2 is connected to the − input of a buffer amplifier 24 and the other terminal is connected to the output of the buffer amplifier 24. The + input of the buffer amplifier 24 is connected to ground. The juncture of the other terminal of capacitance C2 and the output of the buffer amplifier 24 is connected through a divider network of resistances R12 and R13 to ground. The juncture of resistances R12 and R13 is connected to the base of an NPN transistor Q9 having its collector connected to the +V voltage source and its emitter connected through a resistance R16 to the −V voltage source. The juncture of the emitter of transistor Q9 and resistance R16 is connected through a resistance R8 to the − input of the comparator 21.

The juncture of resistances R10 and R11 is also connected through a first set of contacts of a switch E to one terminal of a capacitance C3 to form an integrating circuit. The one terminal of capacitance C3 is connected to ground through a first set of contacts of a switch F and the other terminal is connected to ground through a second set of contacts of switch E. The other terminal of capacitance C3 is also connected through a second set of contacts of switch F to one terminal of a capacitance C4.

The one terminal of capacitance C4 is also connected to the − input of a buffer amplifier 25 and its other terminal is connected to the output of the buffer amplifier 25. The + input of the buffer amplifier 25 is connected to ground. The juncture of the other terminal of capacitance C4 and the output of the buffer amplifier 25 is connected through a divider network of a resistance R14, a resistance R15, and a diode D1 to the −V voltage source. The juncture of resistances R14 and R15 is connected directly to the bases of transistors Q6 and Q8 of the voltage controlled current sources.

Figure 2A:
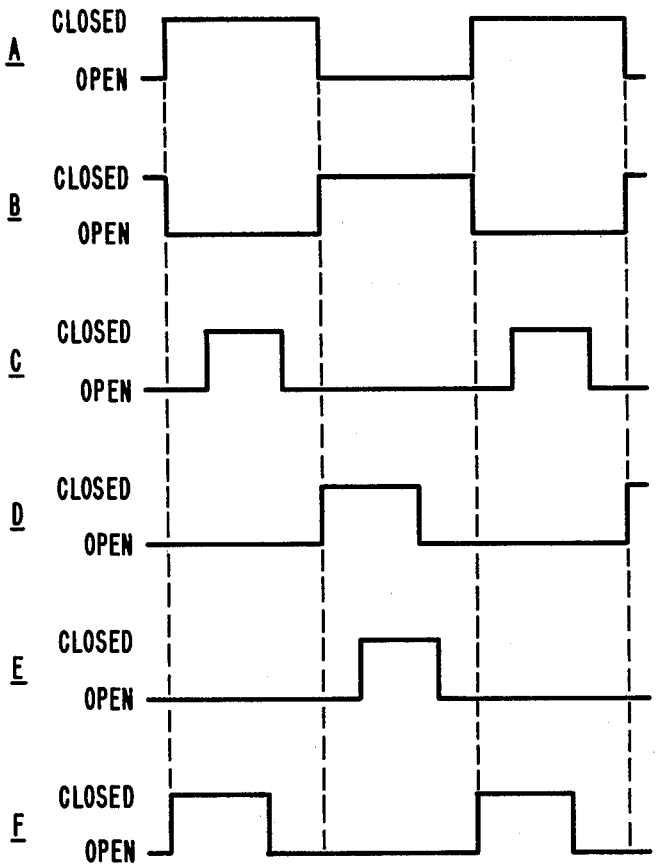
FIG. 2A are waveforms useful in explaining the operation of the circuit of FIG. 2.

FIG. 2A shows waveforms indicating the sequence in which the various switches are opened and closed during operation of the circuit of FIG. 2. It is well understood that although the switches and contacts are shown symbolically in FIG. 2, suitable components may be fabricated in an integrated circuit structure to provide the desired switching functions.

When point A is connected to the + input of the comparator 21 by the switch 22, the output of the comparator is sampled by the closing of switch C while switch D remains open. The sampled output is stored in capacitance C1. When switch 22 connects point B to the + input of the comparator 21 with switch C open, switch D is closed transferring the sampled charge stored in capacitance C1 to capacitance C2. The sampled output occurring as a charge in capacitance C2 is applied through the arrangement of resistances R12 and R13 and transistor Q9 to the − input of the comparator 21. On the next cycle when the switch 22 connects point A to the + input of the comparator 21, the charge stored in capacitance C2 continues to be coupled to the − input of the comparator 21.

Thus, during a cycle when point A is connected to the + input of the comparator 21, the voltage thereat is compared with the voltage thereat during the previous cycle. The combination as described operates in a manner similar to a delta modulator; and since the voltage at point A remains constant, after a suitable number of cycles for initialization of the circuit, the voltage at the − input to the comparator 21 is $V_A \pm \Delta V + V_{OFFSET}$. The differential voltage $\pm\Delta V$ is the step voltage which changes from + to − on alternate cycles. By appropriate selection of components $\pm\Delta V$ may be made very small, as a practical matter of the order of ±200 microvolts.

When the switch 22 connects point B to the + input of the comparator 21, switch C remains open and switch E is closed. Since the voltage at the − input of the comparator 21 is equal to $V_A \pm \Delta V$, $V_B$ is now compared to $V_A \pm \Delta V$. The closing of switch E samples the output of the comparator 21 at this time and causes a charge representative thereof to be stored in capacitance C3. On the next half cycle when the switch 22 connects point A to the + input of the comparator 21, switch E is open and switch F is closed transferring the sample in capacitance C3 to capacitance C4. The charge in capacitance C4 produces a voltage at the juncture of resistances R14 and R15 which is applied to the bases of transistors Q6 and Q8 and serves as a control voltage for the first and second voltage controlled current sources. Since switch F opens before switch E is closed, capacitance C4 continues to apply a control voltage to the bases of transistors Q6 and Q8 while point B is connected to the + input of the comparator 21. The control voltage to transistors Q6 and Q8 adjusts current flow through their respective series arrangements so that, under steady state conditions, the voltage at point B is substantially the same as the voltage at point A. That is, both points A and B are being compared to the voltage at the − input of the comparator 21 which is $V_A \pm \Delta V + V_{OFFSET}$ and, therefore, $V_B = V_A$ to an accuracy of $\pm\Delta V$.

Thus, under steady state conditions the output of the comparator 21 and the relationship between the voltages at points A and B, $V_A$ and $V_B$, are independent of the comparator offset voltage, $V_{OFFSET}$. The sampled feedback arrangement provides infinite DC gain, and therefore any offset voltage in the integrator circuits has no effect since it is in the DC loop.

While there has been shown and described what is considered a preferred embodiment of the present invention, it will be obvious to those skilled in the art that various changes and modifications may be made therein without departing from the invention as defined by the appended claims.

What is claimed is:

1. A source of reference voltage comprising a first series arrangement including a first transistor means, a first resistance means, a second resistance means, and a first voltage controllable current source means connected in series;

a second series arrangement including a second transistor means and a second voltage controlled current source means connected in series;

an output terminal connected between the juncture of the second resistance means and the first current source means;

balancing means for equalizing the voltage at the juncture of said first and second resistance means and the juncture of said second transistor means and said second current source means including comparator means having a first input, a second input, and an output; said comparator means being operable to produce a first output condition at the output when the voltage at the first input is greater than the voltage at the second input, and to produce a second output condition at the output when the voltage at the second input is greater than the voltage at the first input;

comparator input switching means for alternately connecting the first input of the comparator means to the juncture of the second transistor means and second current source means and the juncture of the first and second resistance means;

first sampling means for sampling the output of the comparator means when the first input of the comparator means is connected to the juncture of the second transistor means and second current source means;

first storage means coupled to the first sampling means and to the second input of the comparator means for storing the output of the comparator means sampled by the first sampling means and applying a voltage representative thereof to the second input of the comparator means;

second sampling means for sampling the output of the comparator means when the first input of the comparator means is connected to the juncture of the first and second resistance means; and second storage means coupled to the second sampling means and to the first and second current source means for storing the output of the comparator means sampled by the second sampling means and applying a voltage representative thereof to the first and second current source means whereby current flow through the first and second series arrangements is controlled by the voltage applied to the first and second current source means maintaining the voltage at the juncture of the first and second resistance means substantially equal to the voltage at the juncture of the second transistor means and second current source means.

2. A source of reference voltage in accordance with claim 1 including first capacitance means operable to be coupled to the output of the comparator means for storing a sample of the output of the comparator means when the first input of the comparator means is connected to the juncture of the second transistor means and second current source means;

second capacitance means operable to be coupled to the first capacitance means for receiving the sample stored in the first capacitance means when the first input of the comparator means is connected to the juncture of the first and second resistance means;

third capacitance means operable to be coupled to the output of the comparator means for storing a sample of the output of the comparator means when the first input of the comparator means is connected to the juncture of the first and second resistance means; and fourth capacitance means operable to be coupled to the third capacitance means for receiving the sample stored in the third capacitance means when the first input of the comparator means is connected to the juncture of the second transistor means and second current source means.

3. A source of reference voltage in accordance with claim 2 including first capacitance switching means for coupling the first capacitance means to the output of the comparator means when the first input of the comparator means is connected to the juncture of the second transistor means and second current source means and for decoupling the first capacitance means from the output of the comparator means when the first input of the comparator means is connected to the juncture of the first and second resistance means;

second capacitance switching means for connecting the second capacitance means to the first capacitance means when the first input of the comparator means is connected to the juncture of the first and second resistance means and for disconnecting the second capacitance means from the first capacitance means when the first input of the comparator means is connected to the juncture of the second transistor means and second current source means;

third capacitance switching means for coupling the third capacitance means to the output of the comparator means when the first input of the comparator means is connected to the juncture of the first and second resistance means and for decoupling the third capacitance means from the output of the comparator means when the first input of the comparator means is coupled to the juncture of the second transistor means and second current source means; and fourth capacitance switching means for connecting the fourth capacitance means to the third capacitance means when the first input of the comparator means is connected to the juncture of the second transistor means and second current source means and for disconnecting the fourth capacitance means from the third capacitance means when the first input of the comparator means is connected to the juncture of the first and second resistance means.

4. A source of reference voltage in accordance with claim 3 wherein said first capacitance switching means is operable to couple the first capacitance means between the output of the comparator means and a point of fixed potential when the first input of the comparator means is connected to the juncture of the second transistor means and second current source means and is operable to decouple the first capacitance means from the output of the comparator means and the point of fixed potential when the first input of the comparator means is connected to the juncture of the first and second resistance means;

said second capacitance switching means is operable to connect the first capacitance means between the point of fixed potential and the second capacitance means when the first input of the comparator means is connected to the juncture of the first and second resistance means and is operable to disconnect the first capacitance means from the point of fixed potential and the second capacitance means when the first input of the comparator means is connected to the juncture of the second transistor means and second current source means;

said third capacitance switching means is operable to couple the third capacitance means between the output of the comparator means and the point of fixed potential when the first input of the comparator means is connected to the juncture of the first and second resistance means and is operable to decouple the third capacitance means from the output of the capacitance means and the point of fixed potential when the first input of the comparator means is connected to the juncture of the second transistor means and second current source means; and said fourth capacitance switching means is operable to connect the third capacitance means between the point of fixed potential and the fourth capacitance means when the first input of the comparator means is connected to the juncture of the second transistor means and second current source means and is operable to disconnect the third capacitance means from the point of fixed potential and the fourth capacitance means when the first input of the comparator means is connected to the juncture of the first and second resistance means.

5. A source of reference voltage in accordance with claim 4 including a first source of operating potential;

a second source of operating potential;

said first series arrangement being connected between said first and second sources of operating potential; and said second series arrangement being connected between said first and second sources of operating potential.

6. A source of reference voltage in accordance with claim 5 wherein said first voltage controlled current source means includes a first current source transistor means having a control electrode;

said second voltage controlled current source means includes a second current source transistor means having a control electrode;

the control electrodes of said first and second current source transistor means being directly connected to each other and being coupled to said second storage means whereby the same voltage is applied to both control electrodes from the second storage means; and said first and second current source transistor means having a fixed ratio of current flowing therethrough over a predetermined range of voltages applied to the control electrodes thereof.

* * * * *